US006398829B1

(12) United States Patent
Shinler et al.

(10) Patent No.: US 6,398,829 B1
(45) Date of Patent: Jun. 4, 2002

(54) FILTER SYSTEM FOR MOBILE DEBRIS COLLECTION MACHINE

(75) Inventors: Kevin L. Shinler, North Branch; Michael L. Blehert, Crystal, both of MN (US)

(73) Assignee: Tennant Company, Golden Valley, MN (US)

( * ) Notice: Subject to any disclaimer, the term of this patent is extended or adjusted under 35 U.S.C. 154(b) by 0 days.

(21) Appl. No.: 09/496,095

(22) Filed: Feb. 1, 2000

(51) Int. Cl.[7] ..... E01H 1/08; B01D 50/00; B01D 29/52; B01D 33/00; B01D 47/06

(52) U.S. Cl. ..... 55/317; 55/324; 55/356; 55/401; 55/414; 55/429; 55/472; 55/482; 55/484; 55/521; 96/243; 15/340.3

(58) Field of Search ..... 55/385.3, 482, 55/484, 483, 317, 324, 401, 429, 521, 467, 472, 473, 414, 418, 356; 96/243; 15/340.3, 340.4, 347, 352

(56) References Cited

U.S. PATENT DOCUMENTS

| | | | | |
|---|---|---|---|---|
| 2,701,377 A | | 2/1955 | Luksch et al. | |
| 2,719,596 A | | 10/1955 | Kent et al. | |
| 3,006,021 A | | 10/1961 | Patch | |
| 3,173,777 A | | 3/1965 | Tamny | |
| 3,221,358 A | * | 12/1965 | Dickson | 15/340.3 |
| 3,588,944 A | | 6/1971 | Fromknecht et al. | |
| 4,007,026 A | | 2/1977 | Groh | |
| 4,373,227 A | * | 2/1983 | Kimzey et al. | 15/347 |
| 4,533,371 A | | 8/1985 | Nakamura | |
| 4,554,701 A | | 11/1985 | Van Raaij | |
| 4,708,723 A | * | 11/1987 | Howeth | 15/340.3 |
| 4,811,453 A | | 3/1989 | Lubraniecki | |
| 4,838,907 A | | 6/1989 | Perry | |
| 4,894,881 A | | 1/1990 | Palmer et al. | |
| 5,090,083 A | | 2/1992 | Wulff | |
| 5,129,124 A | | 7/1992 | Gamou et al. | |
| 5,129,125 A | | 7/1992 | Gamou et al. | |
| 5,303,448 A | * | 4/1994 | Hennessey et al. | 15/340.3 |
| 5,500,979 A | | 3/1996 | Worwag | |
| 5,588,179 A | | 12/1996 | Bargiel et al. | |
| 5,608,947 A | | 3/1997 | Knowlton et al. | |
| 5,771,532 A | | 6/1998 | Munnoch | |
| 5,840,103 A | | 11/1998 | Dyson | |
| 5,867,863 A | | 2/1999 | McCormick | |

FOREIGN PATENT DOCUMENTS

| | | | |
|---|---|---|---|
| DE | 2326241 | * 12/1974 | 15/340.4 |

* cited by examiner

*Primary Examiner*—Robert A. Hopkins
(74) *Attorney, Agent, or Firm*—Fulbright & Jaworski LLP; John F. Klos, Esq.

(57) ABSTRACT

A mobile debris collection machine with an improved filter system includes a chassis, wheels for supporting the chassis, a debris collection device on the chassis, a debris container on the chassis, and a vacuum system on the chassis for moving dust and debris from the debris collector to the container. The vacuum system includes a dust and debris inlet, a vacuum fan, a dust and debris conduit extending from the inlet to a deflector which directs dust and debris from the inlet toward an area adjacent the vacuum chamber which is positioned above the debris container. There is a first filter stage upstream of the vacuum fan and attached thereto for rotation with the fan. There are a plurality of second filter stages, each downstream of the vacuum fan with the air flow from the vacuum fan being generally equally divided between the plurality of second filter stages. There is an air outlet for each second filter stage and a diffuser mounted in connection with each air outlet.

33 Claims, 2 Drawing Sheets

FILTER SYSTEM FOR MOBILE DEBRIS COLLECTION MACHINE

THE FIELD OF THE INVENTION

The present invention relates to an improved dust collection and filter system for use in a mobile debris collection machine such as that manufactured by Tennant Company of Minneapolis, Minn. and sold under the trademark "Litter Hawk." It is important in mobile debris and dust collection machines to provide a filter system which will remove dust from the air stream before it is discharged into the atmosphere. Normally, debris collection machines will use a high volume of air flow as this is necessary to insure adequate dust and debris pickup. It is important that the air discharged from the machine be as dust-free as possible. Concurrent with the problem of removing dust is to provide a filter system which is sufficiently adequate that it does not require constant maintenance and removal of filter elements for cleaning. Further, any dust collection system which will easily clog will create a back pressure which can adversely affect vacuum performance and thus litter pickup.

The present invention is addressed to the above-described problems and specifically functions with a two-stage dust and debris separation system which insures that the high volume of air flow will be adequately filtered before discharge and that the filter system will remain unclogged for a substantial period of machine use. The system includes a first filter stage which is formed by a rotating perforated plate attached to the vacuum fan of the air flow system and which separates debris and a high percentage of the dust from the dust and debris collected at the machine inlet. The air flow from the vacuum fan is divided into two parallel paths, each having a second stage filter formed of a pair of pleated filter elements joined at the top and separated at the bottom.

SUMMARY OF THE INVENTION

The present invention relates to an improved filter system for a debris collection machine.

A primary purpose of the invention is to provide a filter system which comprises multiple filter stages, with the last filter stage including parallel air flow paths, each of which terminates in pleated filter elements.

Another purpose of the invention is to provide an improved filter system in which the first stage comprises a perforated plate, rotatable with the vacuum fan, and separating debris from the air flow and with the second filter stage comprising parallel air flow paths, each of which terminates in pleated filter elements.

Another purpose of the invention is to provide an improved filter system in which there is a deflector located adjacent the vacuum fan and first filter stage to direct dust and debris in the direction of rotation of these elements to spin the debris into the collecting canister to assist in compacting the debris therein.

Another purpose of the invention is to provide a filter system as described including a pulsed water spray positioned to direct water across the first stage filter element.

Another purpose is to provide a filter system as described in which each of the outlets of the second filter stages have air diffusers in the form of screens to disperse and direct the outlet air so that it does not disturb debris lying outside or along the swept path.

Another purpose is to provide a mobile debris collection machine as described with an improved filter system and with a debris canister which may have an over-center linkage to facilitate release and removal of debris from the collection canister.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to an improved filter system for a mobile debris collection machine and is particularly described in connection with such a machine manufactured by Tennant Company and sold under the trademark "Litter Hawk." The invention obviously has wider application and the description in connection with that specific machine is for illustrative purposes only. The "Litter Hawk" is illustrated in U.S. patent application Ser. No. 09/320,150, filed on May 26, 1999, now U.S. Patent 6,202,243, the disclosure of which is herein incorporated by reference.

Figures 1, 2, 3:
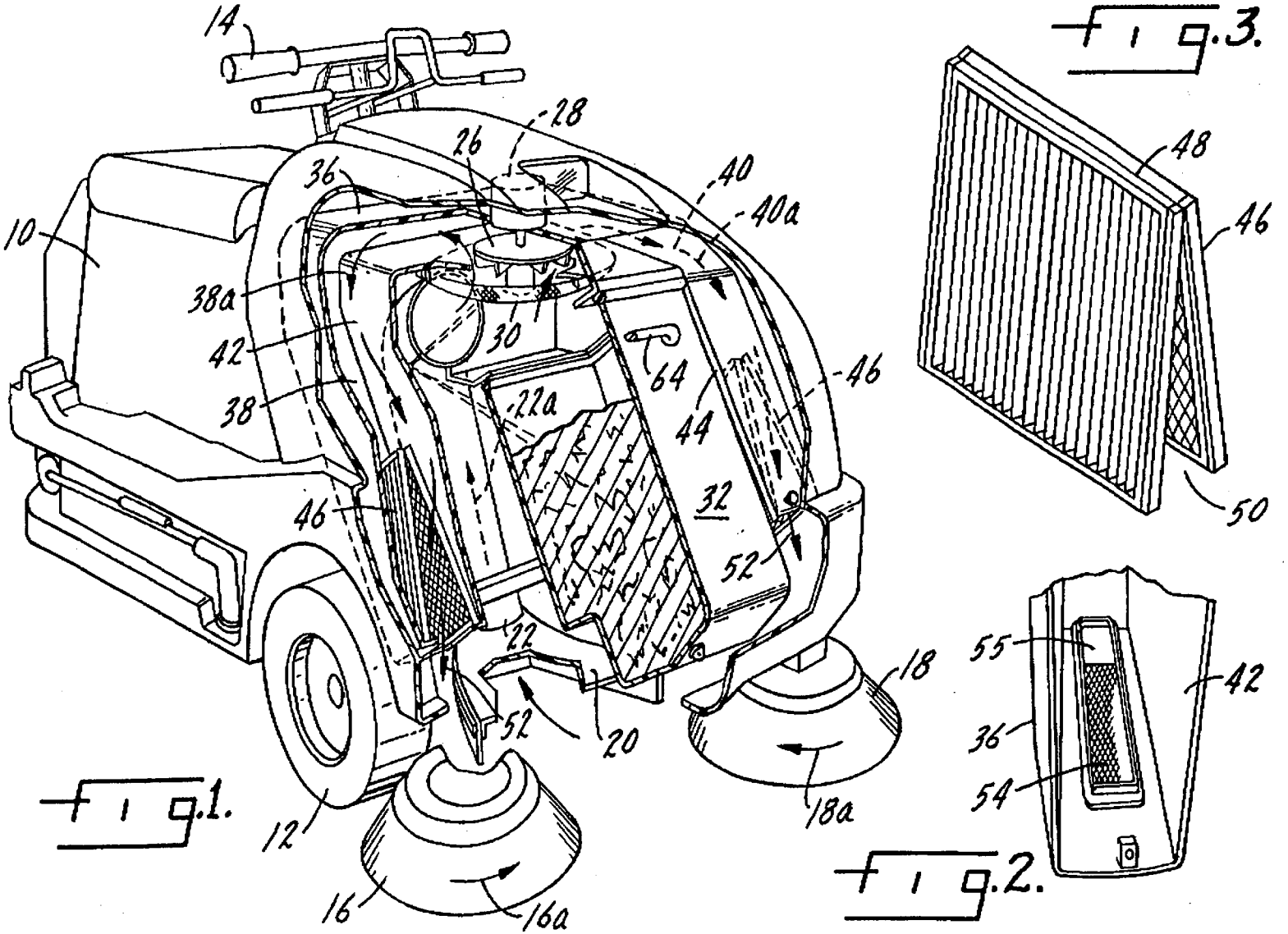
FIG. 1 is a perspective, with portions broken away, illustrating the mobile debris collection machine and improved filter system of the present invention.
FIG. 2 is a partial enlarged perspective illustrating the diffuser and filter outlet.
FIG. 3 is an enlarged perspective of the pleated filter elements used in the second filter stage.

In FIG. 1 there is a chassis 10 mounted on forward wheels 12, with the rear wheels not being shown. There are driver controls 14 for use in steering the machine and there will be an instrument panel, not shown, for use by the driver or operator in controlling the various machine functions.

There are a pair of sweeping brushes 16 and 18 which will rotate in the direction of arrows 16*a* and 18*a* to direct dust and debris toward an inlet shroud 20 which functions as the collection inlet. Preferably, the machine will be operated by a gasoline or diesel engine, or it could be electrically driven and powered by batteries. The particular type of power supply is not important, as what is essential is that there be power to move the brushes and the vacuum fan and to propel the machine in a desired manner.

The dust and debris swept by the brushes 16 and 18 and passing through the inlet shroud 20, will flow upwardly through a conduit 22 in the direction of arrow 22*a* until it reaches a deflector 24 which will direct the incoming dust and debris in a direction consistent with the rotation of the vacuum fan 26 which is driven by a motor 28. The vacuum fan forms a vacuum chamber above the debris cannister. Positioned beneath the vacuum fan is a perforated plate 30 which will be attached to the fan, rotatable therewith, and forms the first filter stage for the dust collection system. Positioned directly beneath the vacuum fan and the rotating plate 30 is the debris canister 32, which will be described in more detail hereinafter. The canister is shown partially filled with litter. The deflector 24 will direct the inlet air and debris round the outer perimeter of the vacuum chamber below the rotating plate 30 in such a manner as to spin the debris into the canister and compact it therein. This reduces turbulence in the debris canister and reduces shredding of debris and re-circulation of dust. Rotation of the debris as described assists in its separation from the air stream with the lighter, dust and air moving up through the center of the rotating plate 30, past the vacuum fan into the to be described second filter stages.

Positioned at the outlet of the deflector 24 is a water spray nozzle 34 which will direct a pulsating spray of water across the air inlet 22 of the vacuum chamber and assist in separating the dust and debris. In this connection, there may also be a water spray near the shroud inlet 20 if desired.

Within the chassis 10 there is an inner housing 36 which forms the outer boundary of two generally parallel dust flow paths 38 and 40, one on each side of the vacuum fan. Air moves into each of these dust flow paths in the direction of the arrows 38a and 40a which has the effect of generally equally dividing air from the fan into two second-stage filter paths. The inside of each of the air flow paths 38 and 40 is formed by walls 42 and 44.

Within each of the second air flow paths 38 and 40, and generally adjacent the outlet ends thereof, there are a pair of pleated filter elements, shown in FIG. 3 and designated at 46. These elements are formed into a v-shape, attached at the top as at 48, with an open bottom indicated at 50. Splitting the outlet air flow reduces the face velocity by one half to each of the second stage filters and the v-shaped filter configuration provides for very efficient use of the available filter area in the pleated filter elements.

At the outlet end of each of the dual air flow paths 38 and 40, the air flows, as shown by arrows 52, toward a diffuser which is in the form of a screen 54. The screens 54 do not totally close the outlet but reduce air flow so that a portion of the outlet air passes through the diffusers toward the ground in the area of the side brushes and the remaining outlet air passes through an opening 55 toward the center and rear of the machine. What is important is to exhaust the outlet air without disturbing or blowing away any debris. The dual-pleated filter element 46 is very useful in that it is easily removable and its elements may then be spread apart and hosed down to remove the accumulated dust.

Figure 4:
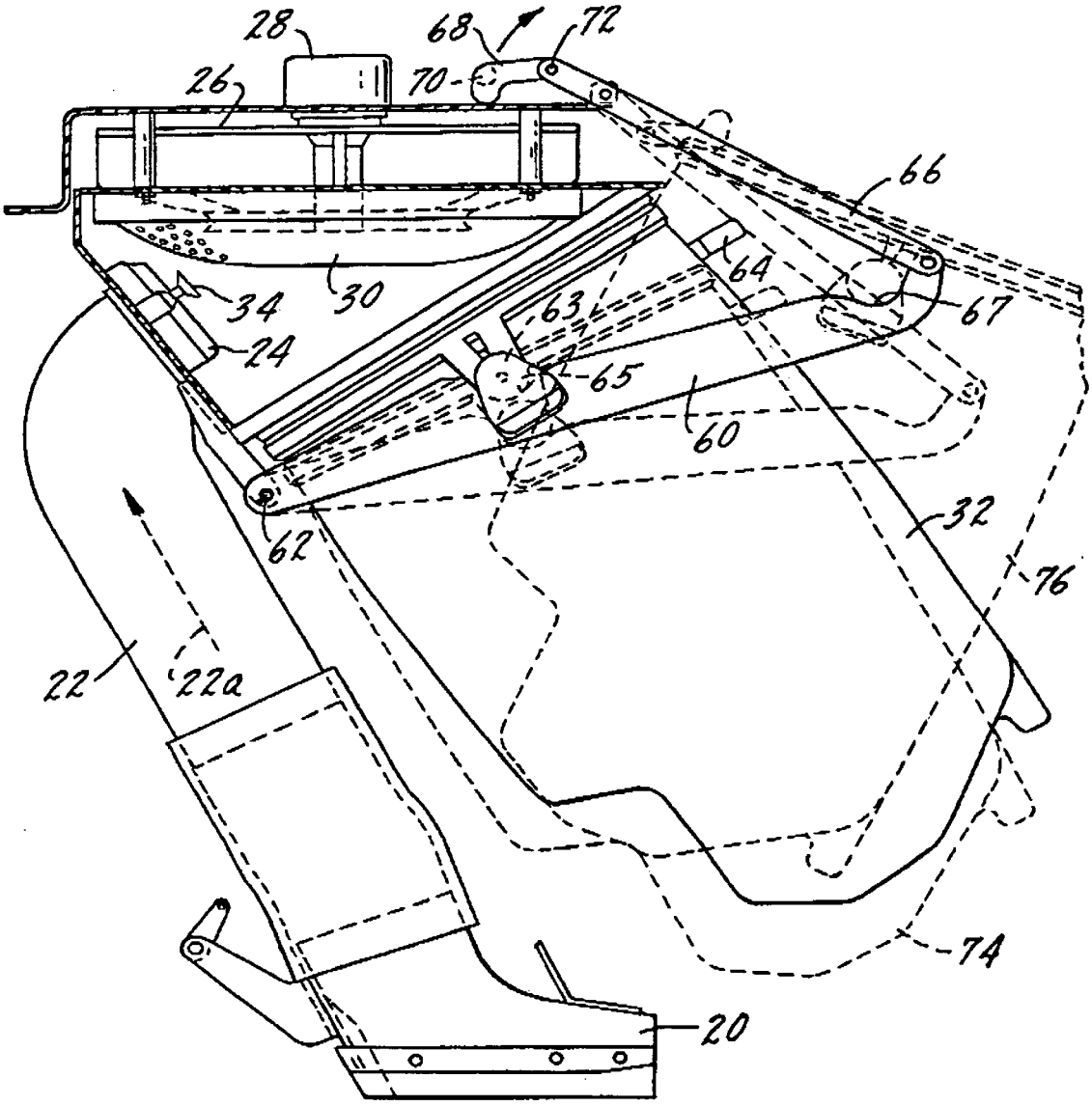
FIG. 4 is an enlarged side view, with different positions shown in broken lines, illustrating the movable debris collection canister.

The debris canister 32, which is illustrated in detail in FIG. 4, is in the normally closed position as shown in full line. When the machine is in use, the canister will be covered by the hood of the chassis 10. The canister is beneath the vacuum fan and the rotating plate 30 and in position to receive the debris as it is separated by the rotating perforated plate. A lawn or garbage bag may be folded over the edges of the canister and then removed and emptied when it is full. In the alternative, the canister itself may be removed and emptied.

The canister 32 is supported on a pair of arms 60, each of which is pivoted to the chassis as at 62. Each side of the canister has a rolling retainer 63 which, in the closed full line position of FIG. 4, rests in a slot 65 in each of the canister support arms 60. Each of the arms 60 is pivotally attached to a lever 66, with the two levers being attached to links 68 which are joined together by a cross rod 70. The links 68 and cross rod 70 together form an overcenter latch. The links 68 are pivoted to the levers 66 as at 72.

To empty the debris container, the hood of the machine must first be raised to provide operator access to the latching mechanism made up of rod 70 and links 68 and to the container handle 64. The latch mechanism is moved from the full line position of FIG. 4 to the broken line position of this figure, which has the effect of releasing the debris container so it is now unlatched and the seal between the top of the canister and the inner housing 36 is broken. The unlatched position of the canister is indicated by broken lines 74.

The debris container may then be moved to the second broken line position 76 in which the support retainers 63 now reside in a second outward slot 67 in each of the support arms 60. The operator may now move the latch mechanism back to the full time position to lock the canister for debris removal. The operator then has complete access to the interior of the canister and may remove a trash bag if one is so used or may remove the canister itself from its supporting structure for emptying of its contents.

The described filter system, and the canister which forms a part of the debris collection apparatus, provides two-stage filtering. The incoming debris is directed by the deflector in the direction of rotation of the fan impeller and the attached perforated plate. This assists in debris and dust separation and assists in compacting the debris within the container. Air flow, after the vacuum fan, moves toward two second-stage filters which operate in parallel and generally equally divide the airflow. Each secondary filter stage consists of a pair of filter elements arranged in a v-shaped configuration to make advantageous use of the filter media. A portion of the air flowing outwardly through the pleated filters will pass through a diffuser for dispersion of the outlet air. A pulsed water spray will direct liquid across the chamber inlet which assists in debris and dust separation from the air flowing through the machine.

The canister, which is easily removable by the operator, may contain a conventional lawn or garden bag or the canister itself may be packed with litter and removed when convenient. The debris canister may be removed without opening the filter compartments, which are normally very dusty and dirty. Further, the debris canister may be opened, tilted forward, and oversized debris dropped in and the canister closed without removing, lifting or opening any of the filter compartments.

Debris may be swept either wet or dry and out of standing water without the filters getting wet. Water is separated from the air stream by the rotating fan since the water is heavy and will stay or drop into the canister below the vacuum fan. Excess water may be drained out of the bottom of the canister before dumping.

The rotating screen and directional airflow push or direct the debris such as rope, neckties, foam wires, plastic bags, etc., down into the canister rather than having such debris become tangled in the screen and the rotating fan.

Whereas the preferred form of the invention has been shown and described herein, it should be realized that there may be many modifications, substitutions and alterations thereto.

The embodiments of the invention in which an exclusive property or privilege is claimed are defined as follows:

1. A mobile debris collection machine having an improved filter system including a chassis, wheels for supporting said chassis, debris collection means on said chassis, a debris container on said chassis, a vacuum system on said chassis for moving dust and debris from said collection means to said container, said vacuum system including a dust and debris inlet, a vacuum fan in a vacuum chamber, a dust and debris conduit extending from said inlet to direct dust and debris from said inlet around the perimeter of the vacuum chamber, said vacuum chamber being positioned above said container, a first filter stage upstream of said vacuum fan and attached thereto for rotation therewith, at least one second filter stage, downstream of said vacuum fan, air flow from said vacuum fan being directed to said at least one second filter stage, and an air outlet for said at least one second filter stage.

2. The mobile debris collection machine of claim 1 wherein there are a plurality of second filter stages, each downstream of said vacuum fan, air flow from said vacuum fan being generally equally divided between said plurality of second filter stages.

3. The mobile debris collection machine of claim 2 wherein each of said second filter stages include a plurality of pleated filter elements.

4. The mobile debris collection machine of claim 2 wherein each second filter stage includes a pair of pleated filter elements, each such pair being joined along an upper portion thereof and being spread apart generally near a lower portion thereof.

5. The mobile debris collection machine of claim 1 wherein there are two second filter stages, each being connected in parallel to the outlet side of said vacuum fan.

6. The mobile debris collection machine of claim 5 including a diffuser in the air outlet for each second filter stage.

7. The mobile debris collection machine of claim 6 wherein each diffuser includes a screen through which at least a portion of air flowing through a second stage filter must flow to reach a second filter stage outlet.

8. The mobile debris collection machine of claim 1 in which said first filter stage includes a perforated plate attached to said vacuum fan and rotatable therewith.

9. The mobile debris collection machine of claim 1 including a deflector to direct dust and debris in the direction of rotation of said perforated plate and vacuum fan.

10. The mobile debris collection machine of claim 1 further including a water spray directed across the air inlet opening.

11. The mobile debris collection machine of claim 10 wherein said water spray is located within said deflector and directs water spray across the inlet opening.

12. The mobile debris collection machine of claim 1 wherein said debris container is pivotally mounted on said chassis and movable from a closed position to an open position in which debris may be removed therefrom.

13. The mobile debris collection machine of claim 12 wherein said at least one second filter stage is on a compartment separate from said debris container.

14. The mobile debris collection machine of claim 12 wherein said debris container is movable between a first latched position, a second position, and a third position in which the container is open and locked into a fixed position for debris removal.

15. A mobile debris collection machine having an improved filter system including a chassis, wheels for supporting such chassis, debris collection means on said chassis, a debris container on said chassis, a vacuum system on said chassis for moving dust and debris from said collection means to said container, said vacuum system including a dust and debris inlet, a vacuum fan, a dust and debris conduit extending from said inlet toward said vacuum fan and toward said debris container, multiple filter stages, one upstream of said vacuum fan and one downstream of said vacuum fan for separating debris and dust, said debris container being movably mounted on said chassis and movable from a closed position to a first open position, and being movable relative to the multiple filter stages between the closed position and the first open position.

16. The mobile debris collection machine of claim 15 including a latch mechanism pivotally mounted to said container for latching and releasing said container for movement from the closed position to the first open position.

17. The mobile debris collection machine of claim 16 wherein the pivotal mounting of said container on said chassis includes a pair of pivotal arms attached to said chassis and slidable retainers attached to said container and movable on said arms.

18. A mobile debris collection machine having an improved filter system including a chassis, wheels for supporting such chassis, debris collection means on said chassis, a debris container on said chassis, a vacuum system on said chassis for moving dust and debris from said collection means to said container, said vacuum system including a dust and debris inlet, a vacuum fan, a dust and debris conduit extending from said inlet toward said vacuum fan and toward said debris container, multiple filter stages, one upstream of said vacuum fan and one downstream of said vacuum fan for separating debris and dust, said debris container being movably mounted on said chassis and being movable relative to the multiple filter stages, said debris container being movable relative to the chassis and the multiple filter stages between a closed position and a first open position.

19. The mobile debris collection machine of claim 18 in which said multiple filter stages includes a perforated plate attached to said vacuum fan and rotatable therewith.

20. The mobile debris collection machine of claim 18 further including a water spray directed across the air inlet opening.

21. The mobile debris collection machine of claim 18 wherein said debris container is pivotally mounted on said chassis and movable from a closed position to an open position in which debris may be removed therefrom.

22. A mobile debris collection machine having an improved filter system including a chassis, wheels for supporting said chassis, debris collection means on said chassis, a debris container on said chassis, a vacuum system on said chassis for moving dust and debris from said collection means to said container, said vacuum system including a dust and debris inlet, a vacuum fan in a vacuum chamber, a dust and debris conduit extending from said inlet to direct dust and debris from said inlet around the perimeter of the vacuum chamber, said vacuum chamber being positioned above said container, a first filter stage upstream of said vacuum fan, a plurality of second filter stages, each of said plurality of second filter stages being disposed in one of a plurality of dust and debris conduits extending from said vacuum chamber toward an air outlet, each of said pair of second filter stages being downstream of said vacuum fan, air flow from said vacuum fan being directed to said plurality of dust and debris conduits to said plurality of second filter stages for exit through said air outlets.

23. The mobile debris collection machine of claim 22 in which said first filter stage includes a perforated plate attached to said vacuum fan and rotatable therewith.

24. The mobile debris collection machine of claim 22 further including a water spray directed across the air inlet opening.

25. The mobile debris collection machine of claim 22 wherein said debris container is movably mounted on said chassis and movable from a closed position to an open position in which debris may be removed therefrom.

26. The mobile debris collection machine of claim 22 wherein said plurality of second filter stages are movably separate from said debris container.

27. The mobile debris collection machine of claim 22 wherein said debris container is movable between a first latched position, a second position, and a third position in which the container is open and locked into a fixed position for debris removal.

28. A mobile debris collection machine having an improved filter system including a chassis, wheels for supporting such chassis, debris collection means on said chassis, a debris container on said chassis, a vacuum system on said chassis for moving dust and debris from said collection means to said container, said vacuum system including a dust and debris inlet, a vacuum fan, a dust and debris conduit extending from said inlet toward said vacuum fan and toward said debris container, multiple filter stages, one upstream of said vacuum fan and one downstream of said vacuum fan for separating debris and dust, said vacuum system including a pair of dust and debris conduits extending away from said vacuum fan and each terminating at a separate air outlet, said one downstream filter stage including filters disposed within each of said pair of dust and debris conduits.

29. The mobile debris collection machine of claim 28 in which one of the multiple filter stages includes a perforated plate attached to said vacuum fan and rotatable therewith.

30. The mobile debris collection machine of claim 28 further including a water spray directed across the air inlet opening.

31. The mobile debris collection machine of claim 28 wherein said debris container is pivotally mounted on said chassis and movable from a closed position to an open position in which debris may be removed therefrom.

32. The mobile debris collection machine of claim 28 wherein said multiple filter stages are movably separate from said debris container.

33. The mobile debris collection machine of claim 28 wherein said debris container is movable between a first latched position, a second position, and a third position in which the container is open and locked into a fixed position for debris removal.

* * * * *